US006599109B2

(12) United States Patent
Zamudio et al.

(10) Patent No.: US 6,599,109 B2
(45) Date of Patent: Jul. 29, 2003

(54) SCROLL COMPRESSOR WITH IMPROVED OIL FLOW

(75) Inventors: Carlos Zamudio, Arkadelphia, AR (US); Zili Sun, Arkadelphia, AR (US); Jason Hugenroth, Hope, AR (US); Greg Hahn, Arkadelphia, AR (US); Thomas Barito, Arkadelphia, AR (US); James W. Bush, Skaneateles, NY (US); Joe T. Hill, Bristol, VA (US); John R. Williams, Bristol, VA (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/969,420

(22) Filed: Oct. 2, 2001

(65) Prior Publication Data

US 2002/0047126 A1 Apr. 25, 2002

Related U.S. Application Data

(62) Division of application No. 09/511,761, filed on Feb. 24, 2000, now Pat. No. 6,309,198.

(51) Int. Cl.[7] ..... F04C 18/04; F04C 29/02

(52) U.S. Cl. ..... 418/55.6

(58) Field of Search ..... 418/55.6

(56) References Cited

U.S. PATENT DOCUMENTS

| | | | | |
|---|---|---|---|---|
| 3,314,599 A | | 4/1967 | Rollinger et al. | 418/DIG. 1 |
| 4,343,599 A | * | 8/1982 | Kousokabe | 418/55.6 |
| 5,055,010 A | | 10/1991 | Logan | 418/55.6 |
| 6,082,981 A | | 7/2000 | Nakajima et al. | 418/55.6 |

FOREIGN PATENT DOCUMENTS

| | | | | |
|---|---|---|---|---|
| JP | 61-40483 A | | 2/1986 | 418/55.6 |
| JP | 61-268896 A | | 11/1986 | 418/55.6 |
| JP | 16190 A | | 1/1988 | 418/55.6 |
| JP | 2-146285 A | | 6/1990 | 418/55.6 |
| JP | 4-241702 A | | 8/1992 | 418/55.6 |
| JP | 4-342888 | * | 11/1992 | 418/55.6 |
| JP | 6-10852 A | | 1/1994 | 418/55.6 |

* cited by examiner

*Primary Examiner*—John J. Vrablik
(74) *Attorney, Agent, or Firm*—Carlson, Gaskey & Olds

(57) ABSTRACT

A number of improvements increase the flow of lubricant within a scroll compressor. A centrifugal oil separator is mounted on the discharge port to remove oil from the refrigerant. The oil is returned through a leak path such that the oil can easily return back to a suction pressure chamber. The leak path is preferably upstream of a check valve. Thus, at shutdown, the leak path will not allow upstream components to also equalize in pressure with the suction pressure chamber of the compressor. Further, a number of embodiments include ways of resisting flow of refrigerant through the leak path, while still allowing oil flow. A number of valve elements are described which perform this function. Alternatively, labyrinth flow paths, or positioning of the return paths such that it will be closed when the compressor is shut down are disclosed.

5 Claims, 3 Drawing Sheets

SCROLL COMPRESSOR WITH IMPROVED OIL FLOW

BACKGROUND OF THE INVENTION

This Application is a Divisional of U.S. patent application Ser. No. 09/511,761, filed on Feb. 24, 2000, now U.S. Pat. No. 6,309,198.

This invention relates to a scroll compressor wherein the oil flow is improved to maximize the amount of oil retained within the compressor.

Scroll compressors are becoming widely utilized in refrigerant compression applications. In a scroll compressor, a first scroll has a base with a generally spiral wrap extending from the base. The first scroll member interfits with a second scroll also having a base with a generally spiral wrap extending from its base. The wraps of the two scrolls interfit to define compression chambers. The second scroll is caused to orbit relative to the first scroll, and as the two move relative to each other the compression chambers decrease in size. A refrigerant is trapped in the compression chambers and is compressed toward a central location on the first scroll member. As the refrigerant reaches a central location it moves through a discharge port and into a discharge pressure chamber.

Scroll compressors are typically mounted in a sealed compressor housing. The sealed compressor housings typically enclose both scrolls and an electric motor for driving the second scroll. Typically, the motor is maintained in a suction chamber which is exposed to the suction refrigerant passing to the compressor. This refrigerant assists in cooling the motor.

Some separation point is defined within the housing to separate the discharge and suction pressure chambers. Often, a separate separator plate is utilized to define the suction and discharge pressure chambers. More recently, other ways of defining the separation area between the suction and discharge pressure chamber have been developed. As one example, the first scroll base has been proposed to separate the two chambers.

Lubricant is important to the operation of a scroll compressor. Thus, an oil sump is typically provided within the sealed housing. Oil passes through the shaft which drives the second scroll, and is delivered to the interface of the first and second scrolls during compression. Thus, there is lubricant mixed with the refrigerant as it is compressed. As the compressed refrigerant leaves the compression chambers, it moves into the discharge pressure chamber. From the discharge pressure chamber, the refrigerant moves downstream to the next component in the refrigerant cycle, the condenser. However, since oil may be mixed with the refrigerant, when the refrigerant leaves the compressor, the oil may migrate with the refrigerant. This is somewhat undesirable, as it is desirable to maintain a sufficient quantity of lubricant in the compressor.

It has been proposed to place oil return lines at various locations in the scroll compressor to return lubricant to the sump. However, the proposals to date have not sufficiently separated and returned oil to the sump from the refrigerant prior to the refrigerant leaving the compressor.

SUMMARY OF THE INVENTION

In a disclosed embodiment of this invention, an oil separator is associated with a discharge port of a scroll compressor. The oil separator is preferably a centrifugal oil separator, and the refrigerant with entrained oil is delivered into the centrifugal separator. The combined refrigerant and oil flows through a torturous path, and oil is separated. Preferably, the centrifugal separator has an oil dam to provide an area for buildup of the separated oil. A bleed hole is placed at a location such that the oil in the dam will bleed outwardly and into the discharge pressure chamber. From the discharge pressure chamber a return hole is provided through a separator portion of the scroll compressor which separates the discharge and suction chambers. In a disclosed embodiment, this separator portion is a separator plate; however, as disclosed above, other portions of the scroll compressor can separate the discharge and suction chambers. The return line could be through these other portions in such compressors.

Preferably, the return line is placed at a location upstream from a check valve. At shutdown of the compressor, oil will quickly return to the sump. Thus, the oil bleed hole through the separator portion will fully communicate the suction and discharge chambers. If this bleed hole were downstream of the check valve, then this same communication of pressure would extend to the next component downstream in the refrigerant cycle, the condenser. This would be undesirable. Thus, a check valve is preferably placed downstream of the bleed hole such that at shutdown, the discharge and suction chambers within the compressor will equalize; however, the downstream component of the refrigerant cycle will not equalize in pressure with these chambers.

In alternative ways of maintaining the downstream pressure, the bleed hole is restricted in some fashion. As one example, the bleed hole may be provided with a valve such that the bleed hole is closed when there is no oil to be returned. In one embodiment, the valve may be a float valve that floats to an open position where there is a sufficient quantity of lubricant, but moves to a closed position when there is insufficient lubricant to float the float valve. In another general type of return restriction system, a labyrinth seal is provided to allow oil to return to the sump. However, the same labyrinth path will provide a high resistance to the flow of refrigerant from the discharge to the suction pressure side.

In other embodiments, the return flow could be through the base of the orbiting scroll. Alternatively, the return flow could be through a path which is closed when a refrigerant check valve is closed. In one embodiment, the path extends through the base of the non-orbiting scroll, and has an entry port which is closed by the check valve when in its closed position.

These and other features of this invention can be best understood from the following specification and drawings, the following of which is a brief description.

DETAILED DESCRIPTION OF A PREFERRED EMBODIMENT

Figure 1:
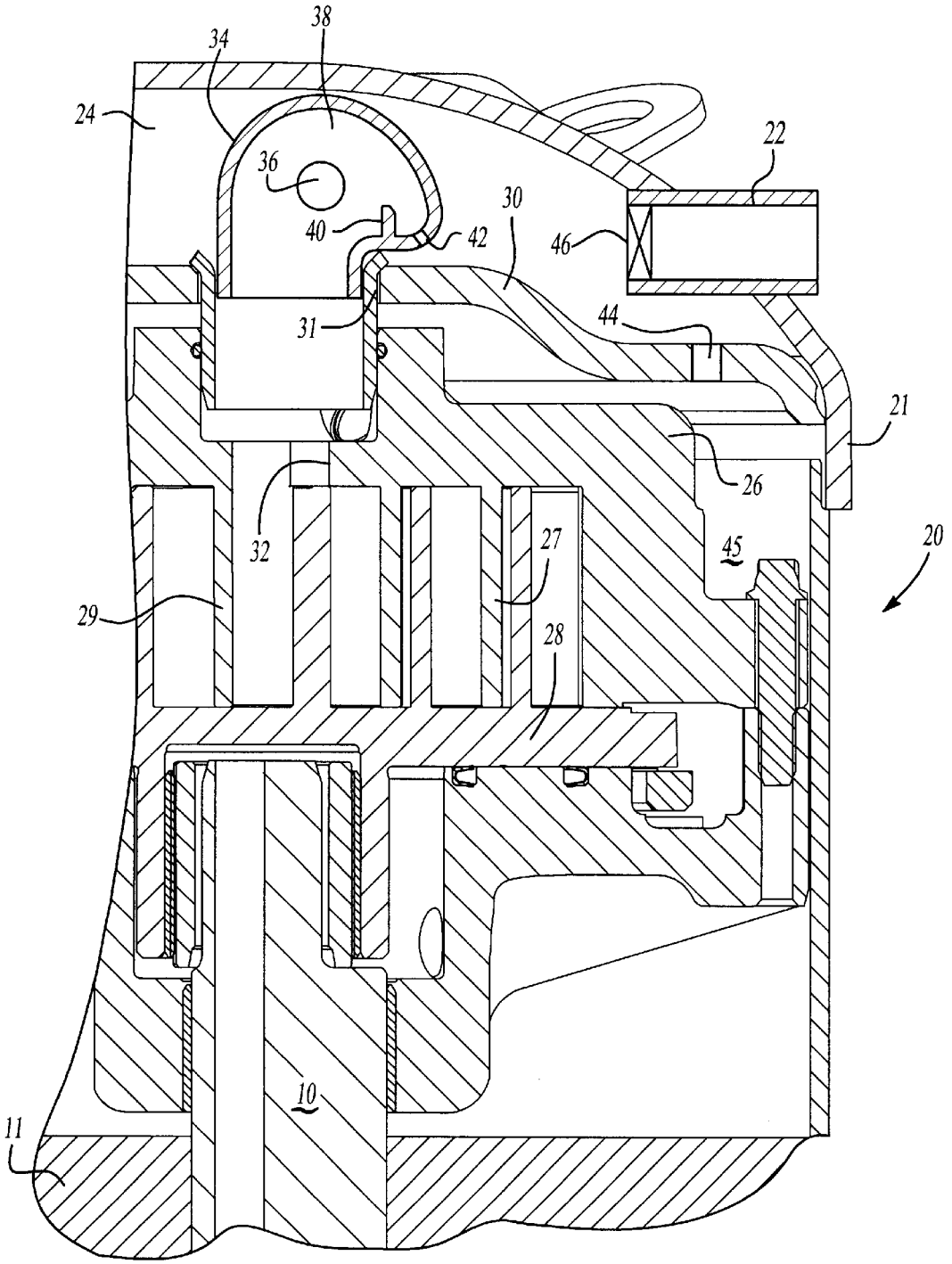
FIG. 1 is a cross sectional view through a scroll compressor incorporating this invention.

FIG. 1 shows a scroll compressor 20 having a housing 21, and a discharge tube 22 leaving the housing, and communicating with a discharge chamber 24. A non-orbiting scroll 26 includes a wrap 27 and an orbiting scroll 28 includes a wrap 29. Orbiting scroll 28 is driven through a shaft 10 via an electric motor 11. A separator plate 30 has a port 31 in communication with a discharge port 32 through the non-orbiting scroll 26.

A centrifugal oil separator 34 has a discharge port 36, and communicates with the discharge port 32. Refrigerant and entrapped oil which are compressed in the compressor are delivered into the centrifugal oil separator 34. The flow bends around the curve 38 of the centrifugal separator. The oil is separated and held in a dam 40. The refrigerant passes through a port 36 and into the chamber 24. The oil trapped in the dam 40 can bleed outwardly through a bleed hold 42 into an area above the plate 30. A bleed hole 44 is formed through the plate 30. The bleed hole allows the oil to return to a suction chamber 45, beneath the plate 30. A check valve 46 is shown schematically on the discharge tube 22. Notably, the check valve is downstream of the bleed hole 44. During operation of the scroll compressor, there will be a sufficient quantity of oil, and the hole 44 will be sufficiently small, that oil will quickly fill the bleed hole, and the pressure in the chambers 24 and 45 will be maintained. At shutdown, however, the oil will quickly leave and be returned to the sump. At that time, the chambers 24 and 45 will communicate through the bleed hole 44. However, since the check valve 46 is downstream of this connection, the downstream portions of the refrigerant cycle will not also bleed back to a suction pressure.

The above described embodiment improves the operation of scroll compressors by removing the lubricant from the refrigerant prior to the refrigerant leaving the compressor. In this way, a greater quantity of lubricant is maintained in the compressor.

Figure 2:
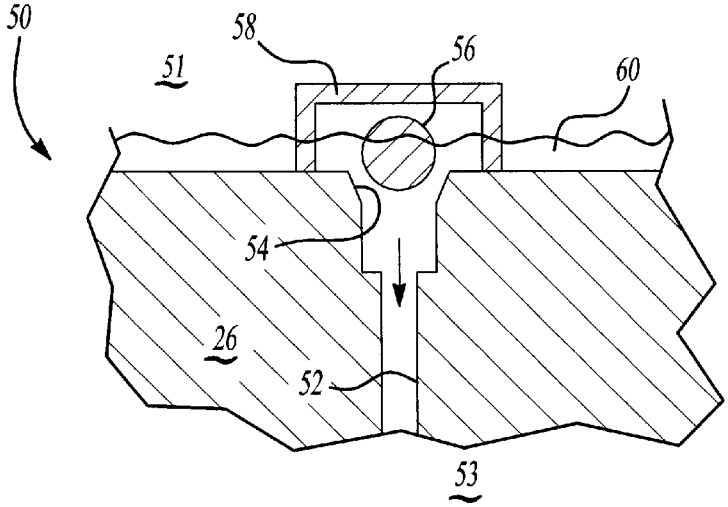
FIG. 2 shows a second embodiment.

Other means for returning the oil are shown in FIGS. 2–7. As shown in FIG. 2, an embodiment 50 has the discharge chamber 51 positioned above a return path 52. The return path 52 returns lubricant to the suction side 53. A valve seat 54 selectively receives a float ball valve 56. A valve cage 58 allows lubricant to flow into the area of the cage, and float the ball 54. As shown, this structure is mounted in the non-orbiting scroll 26, although it could alternatively be mounted in a separator plate. When the compressor is operating, there will be sufficient quantity of oil 60 such that the float valve 56 floats, and oil is allowed to return to the path 52. However, at shutdown, the valve 56 will sit against the seat 54 and block communication. Thus, the discharge and pressure chambers will not bleed together to the same pressure.

Figure 3:
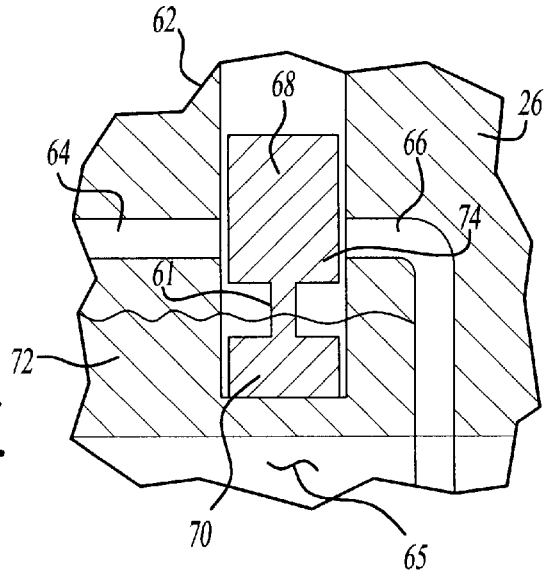
FIG. 3 shows a third embodiment.

FIG. 3 shows yet another embodiment 62 wherein a tap to discharge chamber 64 communicates with a return line 66 to a suction chamber 65. The float valve 68 includes a float portion 70 which is within the lubricant 72. A valve land portion 74 blocks communication between lines 64 and 66 and a recessed portion 61 allows communication between lines 64 and 66. This embodiment operates similar to the FIG. 2 embodiment.

Figure 4:
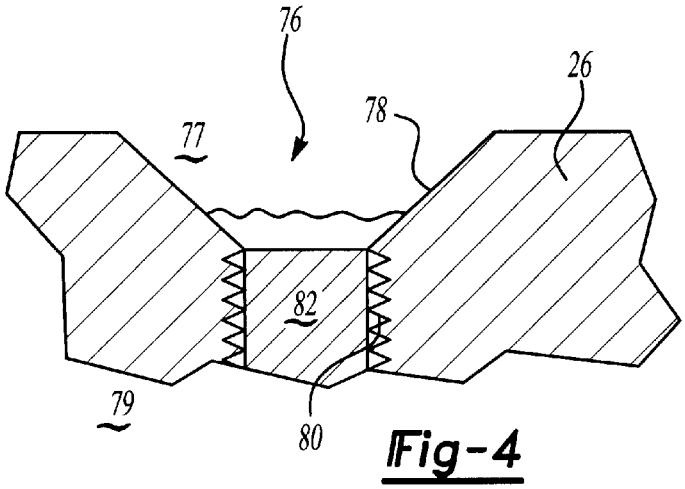
FIG. 4 shows a fourth embodiment.

FIG. 4 shows an embodiment 76 wherein a channel 78 leads returning lubricant from a discharge chamber 77 into a labyrinth path 80. The labyrinth path 80 can be formed simply by cutting a screw thread into an opening in the base of the non-orbiting scroll 26. Oil can flow through the labyrinth path 80 to the suction chamber 79. As shown, a plug 82 is received within the hole, thus forming the labyrinth path. Once the oil has left, the labyrinth path will provide a resistance to the return of gas from the chamber 77 to the chamber 79. Thus, a dissipation of the pressure will be resisted.

Figure 5:
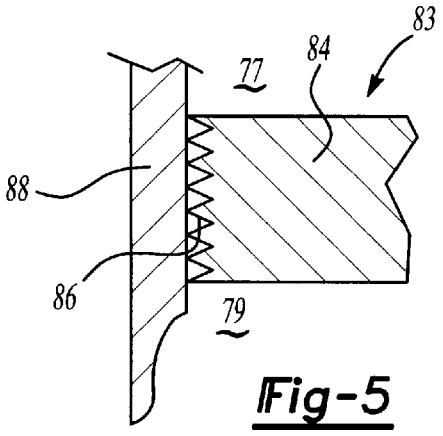
FIG. 5 shows a fifth embodiment.

FIG. 5 shows yet another embodiment 83 wherein the non-orbiting scroll 84 is provided with the thread 86 at its outer periphery. Thus, the labyrinth path is provided between the non-orbiting scroll 84 and the inner surface of the housing wall 88.

Figure 6:
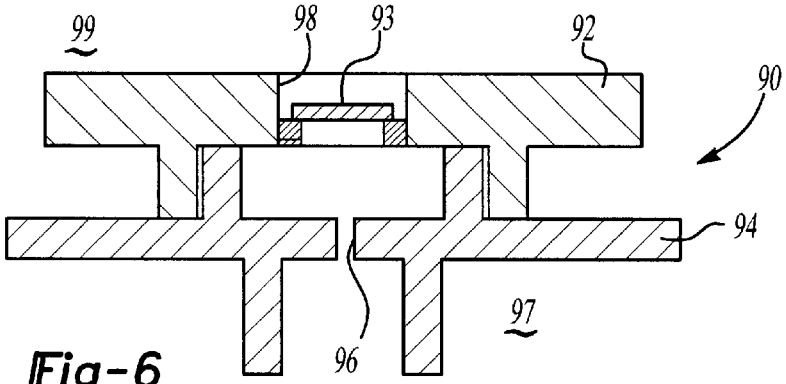
FIG. 6 shows a sixth embodiment.

FIG. 6 shows yet another embodiment 90 where the non-orbiting scroll 92 is positioned adjacent the orbiting scroll 94. A return oil path 96 through the orbiting scroll 94 communicates returned lubricant through a discharge port 98 from the discharge chamber 99 to the suction chamber 97. At shut down, a check valve 93 stops back flow.

Figure 7:
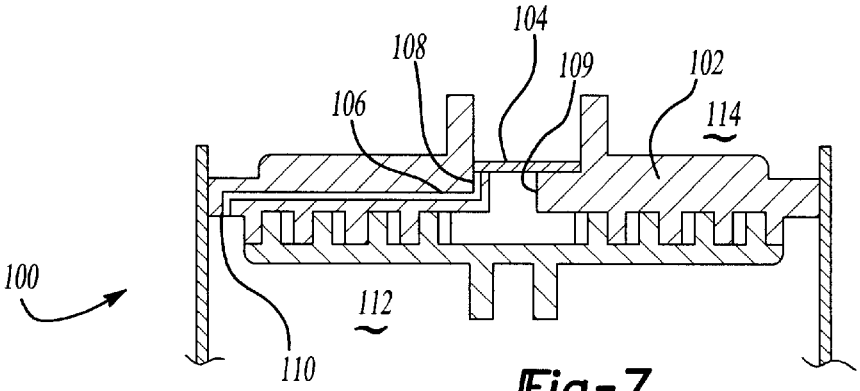
FIG. 7 shows a seventh embodiment.

FIG. 7 shows yet another embodiment 100 where the non-orbiting scroll 102 receives a check valve 104. A path 106 has a tap 108 which is selectively closed by the check valve 104. The check valve 104 also closes the discharge port 109 in the non-orbiting scroll 102. The return path leads to a line 110 which communicates through a suction chamber 112. Thus, when the scroll compressor is operating, the valve 104 is away from the tap 108 and oil can return to the chamber 112. However, at shutdown, the check valve 104 will close the tap 108.

Several preferred embodiments of this invention have been disclosed; however, a worker of ordinary skill in this art would recognize that modifications would come within the scope of this invention. For that reason, the following claims should be studied to determine the true scope and content of this invention.

What is claimed is:

1. A scroll compressor comprising:

a sealed housing;

a scroll compressor pump unit including a first scroll having a base and a generally spiral wrap extending from said base and a second scroll having a base and a generally spiral wrap extending from said base, said generally spiral wraps of said first and second scrolls interfitting to define compression chambers;

an electric motor for driving a shaft, said shaft being operatively connected to cause said second scroll to orbit relative to said first scroll; and said sealed housing being separated into a discharge pressure chamber and a suction pressure chamber, with a component of said scroll compressor pump unit separating said sealed housing into said suction and discharge pressure chambers, an oil return path in communication with said discharge and suction pressure chambers wherein a structure in said oil return path resists flow of refrigerant from said discharge chamber to said suction chamber, wherein said structure is a labyrinth flow path formed in said component.

2. The scroll compressor as recited in claim 1 wherein said component comprises at least one of said scrolls.

3. A scroll compressor comprising:

a sealed housing;

a scroll compressor or pump unit including a first scroll having a base and a generally spiral wrap extending from said base, said generally spiral wraps of said first and second scrolls interfitting to define compression chambers;

an electric motor for driving a shaft, said shaft being operatively connected to cause said second scroll to orbit relative to said first scroll; and said sealed housing being separated into a discharge pressure chamber and a suction pressure chamber, with a component of said scroll compressor pump unit separating said sealed housing into said suction and discharge pressure chambers, an oil return path in communication with said discharge and suction pressure chambers wherein a structure in said oil return path resists flow of refrigerant from said discharge chamber of said suction chamber, wherein said structure to resist is a labyrinth flow path formed by a screw thread.

4. A scroll compressor as recited in claim 3, wherein said labyrinth path is formed at an intermediate position in said component, and a plug is inserted into an inner periphery of said labyrinth path.

5. A scroll compressor as recited in claim 3, wherein said labyrinth path is formed at an outer peripheral surface of said component, and between said outer peripheral surface of said component and an inner peripheral surface of said housing.

* * * * *